US009903333B2

(12) United States Patent
Terada

(10) Patent No.: US 9,903,333 B2
(45) Date of Patent: Feb. 27, 2018

(54) IGNITION APPARATUS FOR AN INTERNAL-COMBUSTION ENGINE

(71) Applicant: DENSO CORPORATION, Kariya, Aichi-pref. (JP)

(72) Inventor: Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/302,558

(22) PCT Filed: Apr. 8, 2015

(86) PCT No.: PCT/JP2015/060939
§ 371 (c)(1),
(2) Date: Oct. 7, 2016

(87) PCT Pub. No.: WO2015/156308
PCT Pub. Date: Oct. 15, 2015

(65) Prior Publication Data

US 2017/0030320 A1 Feb. 2, 2017

(30) Foreign Application Priority Data

Apr. 10, 2014 (JP) ..... 2014-080788

(51) Int. Cl.
*F02P 3/09* (2006.01)
*F02P 3/08* (2006.01)
*H01F 38/12* (2006.01)

(52) U.S. Cl.
CPC ..... *F02P 3/08* (2013.01); *F02P 3/0892* (2013.01); *H01F 38/12* (2013.01)

(58) Field of Classification Search
CPC .. F02P 3/08; F02P 3/0892; F02P 9/002; H01F 38/12
USPC ..... 123/596, 605, 618
See application file for complete search history.

(56) References Cited

U.S. PATENT DOCUMENTS 5,215,066 A 6/1993 Narishige et al.
5,220,901 A 6/1993 Morita et al.

FOREIGN PATENT DOCUMENTS

JP S60-233370 11/1985
JP 2010-106739 5/2010
JP 2011-074906 4/2011
JP 2012-122348 6/2012

*Primary Examiner* — Hai Huynh
(74) *Attorney, Agent, or Firm* — Nixon & Vanderhye PC

(57) ABSTRACT

An ignition apparatus for an internal-combustion engine includes a main ignition CDI circuit that has a main ignition boosting circuit boosting battery voltage and a main ignition capacitor storing electric charge boosted by the main ignition boosting circuit, and that releases the electric charge stored in the main ignition capacitor to a primary coil of an ignition coil to make an ignition plug generate spark discharge, and an energy input circuit that has an energy input boosting circuit boosting battery voltage and an energy input capacitor storing electric charge boosted by the energy input boosting circuit, and that releases the electric charge stored in the energy input capacitor to the primary coil, during a spark discharge started by operation of the main ignition CDI circuit, to make a secondary current flow in the same direction and to a secondary coil of the ignition coil, thereby making spark discharge continue which is started by the operation of the main ignition CDI circuit.

7 Claims, 6 Drawing Sheets

IGNITION APPARATUS FOR AN INTERNAL-COMBUSTION ENGINE

This application is based on the U.S. national phase of International Application No. PCT/JP2015/060939 filed 8 Apr. 2015 which designated the U.S. and claims priority to Japanese Patent Application No. 2014-080788 filed 10 Apr. 2014, the entire contents of each of which are hereby incorporated by reference.

TECHNICAL FIELD

The present invention relates to an ignition apparatus used for an internal-combustion engine (engine), in particular, to a technique for continuing spark discharge.

BACKGROUND ART

For ignition apparatuses, a technique for improving ignitability of an air-fuel mixture in an engine combustion chamber is preferable. As the technique for improving ignitability, there are known a powerful ignition technique for generating strong spark discharge by using a spark plug, and a multiple ignition technique for continuously generating strong spark discharge several times by using a spark plug.

However, these ignition techniques have problems that wear on electrodes of a spark plug increases due to repeated re-discharge, and that power is wastefully consumed. Hence, an ignition apparatus is required which has high ignitability, and which can reduce wear on electrodes of a spark plug and can suppress wasteful power consumption.

As a technique for increasing ignitability and reducing wear on electrodes of a spark plug, a technique for simultaneously activating a "CDI (capacitive discharge) ignition circuit" and a "self-excitation thyristor series inverter ignition circuit" has been proposed (for example, refer to Patent Literature 1).

In the technique of Patent Literature 1, the CDI ignition circuit generates a strong spark discharge multiple times at time intervals, and the self-excitation thyristor series inverter ignition circuit continuously and repeatedly generates a weak spark discharge, whereby "multiple strong spark discharges" and "continuous weak spark discharges" overlap with each other.

(Problem 1)

In the self-excitation thyristor series inverter ignition circuit used in Patent Literature 1, since spark discharges are continued by supplying a current subject to positive and negative resonance to a primary coil, a secondary voltage repeatedly alternates between positive voltage and negative voltage.

As a result, in the technique of Patent Literature 1, due to the alternation of the secondary voltage crossing zero voltage during a spark discharge (during an extension of the spark discharge) by the self-excitation thyristor series inverter ignition circuit, the spark discharge voltage partially lowers in each alternation. As a result, blowout of the spark discharge easily occurs due to a rotational flow or the like generated in a cylinder.

(Problem 2)

The self-excitation thyristor series inverter ignition circuit used in Patent Literature 1 described above uses a complicated resonance circuit (a first resonance circuit using a resonant inductance, a second resonance circuit using a feedback winding, and the like). Hence, the circuit size becomes large. As a result, the ignition apparatus becomes large in size, and increase in cost is caused.

CITATION LIST

Patent Literature

[Patent Literature] JP-A-2011-074906

SUMMARY OF THE INVENTION

Solution to Problem

One embodiment provides an ignition apparatus for an internal-combustion engine which can reduce wear on electrodes of a spark plug and can suppress wasteful power consumption to increase ignitability.

An ignition apparatus for an internal-combustion engine of one embodiment includes: a main ignition CDI circuit that has a main ignition boosting circuit boosting battery voltage and a main ignition capacitor storing electric charge boosted by the main ignition boosting circuit, and that releases the electric charge stored in the main ignition capacitor to a primary coil of an ignition coil to make an ignition plug generate spark discharge; and an energy input circuit that has an energy input boosting circuit boosting battery voltage and an energy input capacitor storing electric charge boosted by the energy input boosting circuit, and that releases the electric charge stored in the energy input capacitor to the primary coil, during a spark discharge started by operation of the main ignition CDI circuit, to make a secondary current flow in the same direction and to a secondary coil of the ignition coil, thereby making spark discharge continue which is started by the operation of the main ignition CDI circuit.

DESCRIPTION OF THE EMBODIMENTS

Figure 1:
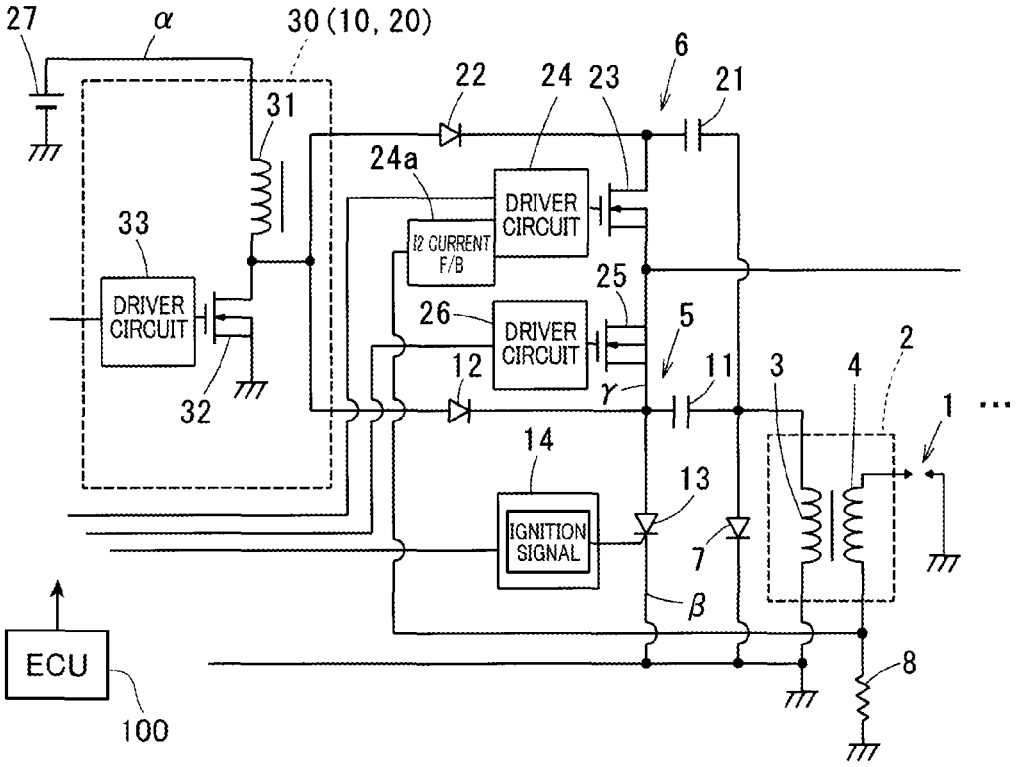
FIG. 1 is a diagram showing a schematic configuration of an ignition apparatus for an internal-combustion engine (first embodiment)

Embodiments of the present invention will be described with reference to the drawings. Note that the following embodiments are disclosed specific examples. Needless to say, the present invention is not limited to the embodiments.

First Embodiment

The first embodiment will be described with reference to FIGS. 1 to 5.

An ignition apparatus according to the first embodiment is mounted in a spark-ignition engine for vehicle traveling, and ignites (fires) an air-fuel mixture in a combustion chamber at predetermined ignition timing (ignition time). Note that an example of the engine is a direct injection type engine, which can perform lean combustion (lean burn combustion) using gasoline as fuel. In this engine, an EGR unit is mounted which returns part of exhaust gas as EGR gas to the engine intake side. In addition, the engine includes a rotational flow control section (rotational flow control means) that generates a rotational flow (tumble flow, swirl flow, or the like) of an air-fuel mixture in a cylinder.

The ignition apparatus of the first embodiment is DI (direct ignition) type used for ignition coils 2 corresponding to respective spark plugs 1 of respective cylinders.

This ignition apparatus performs current application control for a primary coil 3 of the ignition coil 2 based on a command signal (boosting command signal, ignition signal, discharge continuation signal, cylinder selection signal, or the like) provided from an ECU (an abbreviation for engine control unit) configuring the center of engine control. The ignition apparatus performs current application control for the primary coil 3 to control electric energy generated in a secondary coil 4 of the ignition coil 2, thereby controlling spark discharge of the spark plug 1.

Note that the ECU 100 generates and outputs an ignition signal, a discharge continuation signal, a discharge current setting signal, a cylinder selection signal, a boosting command signal, and the like depending on engine parameters (crank angle, warm-up state, engine rotation speed, engine load, and the like) obtained from various sensors and control states of the engine (presence or absence of lean combustion, the extent of a rotational flow, and the like).

The ignition apparatus of the first embodiment includes

- the spark plugs 1 mounted to respective cylinders,
- the ignition coils 2 mounted to the respective spark plugs 1,
- a main ignition CDI circuit 5 making the spark plug 1 generate main ignition, and
- an energy input circuit 6 generating continuous spark discharge continued from the main ignition.

Note that main parts of the main ignition CDI circuit 5 and the energy input circuit 6 are accommodated and disposed in one case as an "ignition circuit unit", and are mounted at places different from those of the spark plugs 1 and the ignition coils 2.

The spark plug 1 is of a known type, and includes a center electrode connected to one end of the secondary coil 4 (output terminal provided to the spark plug 1), and an outer electrode grounded via a cylinder head and the like of the engine. The spark plug 1 starts spark discharge between the center electrode and the outer electrode by high voltage applied from the secondary coil 4.

The ignition coil 2 is known and includes the primary coil 3 and the secondary coil 4 having the number of turns larger than that of the primary coil 3.

The primary coil 3 is connected to a first diode 7 in parallel. The first diode 7 is provided so that a current, which has flowed through the primary coil 3, recirculates to the primary coil 3, and spark discharge is generated only in one direction of a negative direction current.

One end of the secondary coil 4 is connected to the center electrode of the spark plug 1 as described above. The other end of the secondary coil 4 is connected to "one end side of the primary coil 3", or is "grounded". Note that FIG. 1 shows an example in which the other end of the secondary coil 4 is grounded via a discharge current detection resistor 8.

The main ignition CDI circuit 5 has a main ignition capacitor 11 that stores electric charge boosted by the main ignition boosting circuit 10, and releases the electric charge stored in the main ignition capacitor 11 to the primary coil 3 of the ignition coil 2 to make the spark plug 1 generate continuous spark discharge.

Specifically, the main ignition CDI circuit 5 includes

- the main ignition boosting circuit 10 that increases battery voltage,
- the main ignition capacitor 11 that stores electric charge boosted by the main ignition boosting circuit 10,
- a second diode 12 that prevents the electric charge stored in the main ignition capacitor 11 from flowing back to the main ignition boosting circuit 10,
- an ignition switching unit (ignition switching means) 13 (e.g. thyristor, power transistor, MOS transistor, or the like) that turns on and off a first energy input line β inputting the electric charge stored in the main ignition capacitor 11 to the primary coil 3, and
- an ignition driver circuit 14 that controls on-off operation of the ignition switching unit 13.

Note that, as an example of the main ignition switching unit 13 of the first embodiment, a thyristor is used. The ignition driver circuit 14 outputs a thyristor drive signal to the gate of the thyristor based on an ignition signal provided from the ECU 100.

The energy input circuit 6 has an energy input capacitor 21 that stores electric charge boosted by an energy input boosting circuit 20. The energy input circuit 6 releases the electric charge stored in the energy input capacitor 21 to the primary coil 3 during main ignition started by the operation of the main ignition CDI circuit 5 to make a secondary current flow in the same direction and to the secondary coil 4 of the ignition coil 2, thereby continuing spark discharge started by the operation of the main ignition CDI circuit 5.

Specifically, the energy input circuit 6 is operated by a command of the ECU 100 in a driving state in which ignitability decreases (when lean combustion is performed, when a strong rotational flow is generated, when an EGR ratio is high, or when low-temperature start is performed) to improve ignitability of an air-fuel mixture. The energy input circuit 6 includes

- the energy input boosting circuit 20 that boosts battery voltage,
- the energy input capacitor 21 that stores electric charge boosted by an energy input boosting circuit 20,
- a third diode 22 that prevents the electric charge stored in the energy input capacitor 21 from flowing back to the energy input boosting circuit 20,
- an energy input switching section (energy input switching means) 23 (e.g. a MOS transistor, a power transistor) that turns on and off a second energy input line γ inputting the electric charge stored in the energy input capacitor 21 to the primary coil 3;
- an energy input driver circuit 24 that turns on and off the energy input switching section 23,
- a feedback control circuit **24*a* that controls on-off operation of the energy input switching section 23 through the energy input driver circuit, a cylinder distribution switching section (cylinder distribution switching means) 25 (e.g. a MOS transistor, a power transistor, or the like) that selects an input destination (i.e. the spark plug 1 performing continuous spark discharge) of the electric charge stored in the energy input capacitor 21, and a cylinder distribution driver circuit 26 that controls on-off operation of the cylinder distribution switching section 25**.

Note that the energy input capacitor 21 is set so as to be able to store the large amount of electric energy to continue continuous spark discharge over a given time period according to a driving state of the engine (spark duration). The capacitance of the energy input capacitor 21 is larger than the capacitance of the main ignition capacitor 11.

In the first embodiment, the main ignition boosting circuit 10 and the energy input boosting circuit 20 are provided in common. The main ignition boosting circuit 10 and the energy input boosting circuit 20 are provided as a common boosting circuit 30.

The operation of the boosting circuit 30 is controlled by the ECU 100. Specifically, the boosting circuit 30 waits (stops operation) until a predetermined time period passes from the ignition timing. If the predetermined time period has passed from the ignition timing, the boosting circuit 30 boosts the voltage of the battery to charge the main ignition capacitor 11 and the energy input capacitor 21, and completes the charging by the next ignition timing.

A concrete example of the boosting circuit 30 will be further described. The boosting circuit 30 is a DC-DC converter that boosts the voltage of an in-vehicle battery 27 (battery voltage) and outputs the boosted voltage. The boosting circuit 30 includes a choke coil 31 having one end that is connected to a battery voltage supply line α, a boosting switching unit (boosting switching means) 32 (MOS transistor, power transistor, or the like) that interrupts a conduction state of the choke coil 31, and a boosting driver circuit 33 that repeatedly turns on and off the boosting switching unit 32.

Note that the boosting driver circuit 33 is provided so as to repeatedly turn on and off the boosting switching unit 32 at predetermined intervals over a time period during which the boosting command signals are provided from the ECU 100.

In the embodiment, the first energy input line β and the second energy input line γ are provided in series. That is, as shown in FIG. 1, the energy input switching section 23, the cylinder distribution switching section 25, and the ignition switching unit 13 are provided in series.

Hence, turning on only the ignition switching unit 13 supplies the electric energy stored in the main ignition capacitor 11 to the primary coil 3.

In addition, on-off controlling the energy input switching section 23 and turning on both the cylinder distribution switching section 25 and the ignition switching unit 13 supply the electric energy stored in the energy input capacitor 21 (the electric energy controlled by the interruption of the energy input switching section 23) to the primary coil 3 of the ignition coil 2 selected by the cylinder distribution switching section 25 (i.e. the primary coil 3 of the ignition coil 2 in which main ignition is started).

The feedback control circuit 24*a* controls an on-off state of the energy input switching section 23 via the energy input driver circuit 24 to control the electric energy to be input to the primary coil 3 to maintain a secondary current within a predetermined target range over the time period during which the discharge continuation signal is provided.

Figure 3:
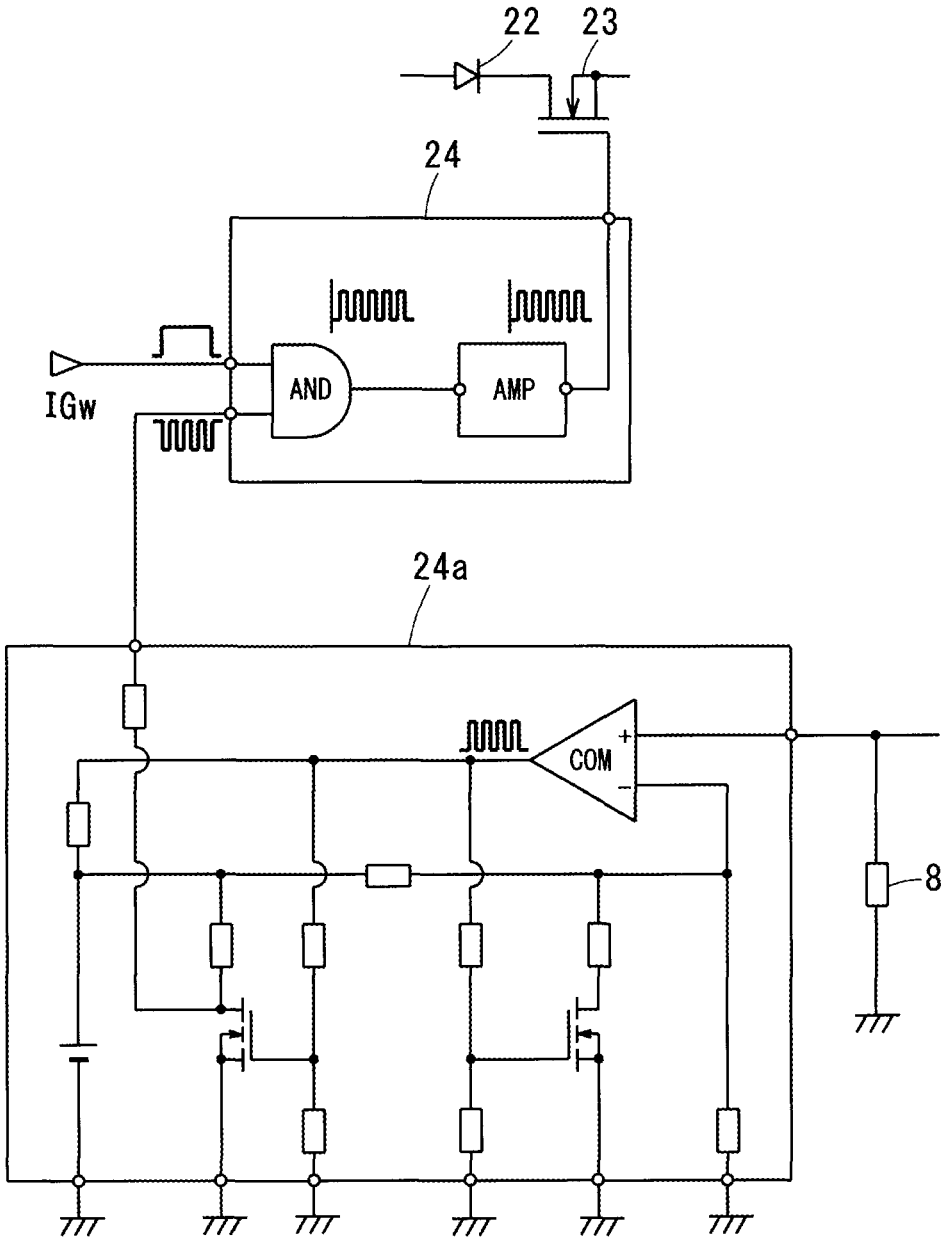
FIG. 3 is an electric circuit diagram of a driver circuit for energy input and a feedback control circuit (first embodiment)
Figure 4:
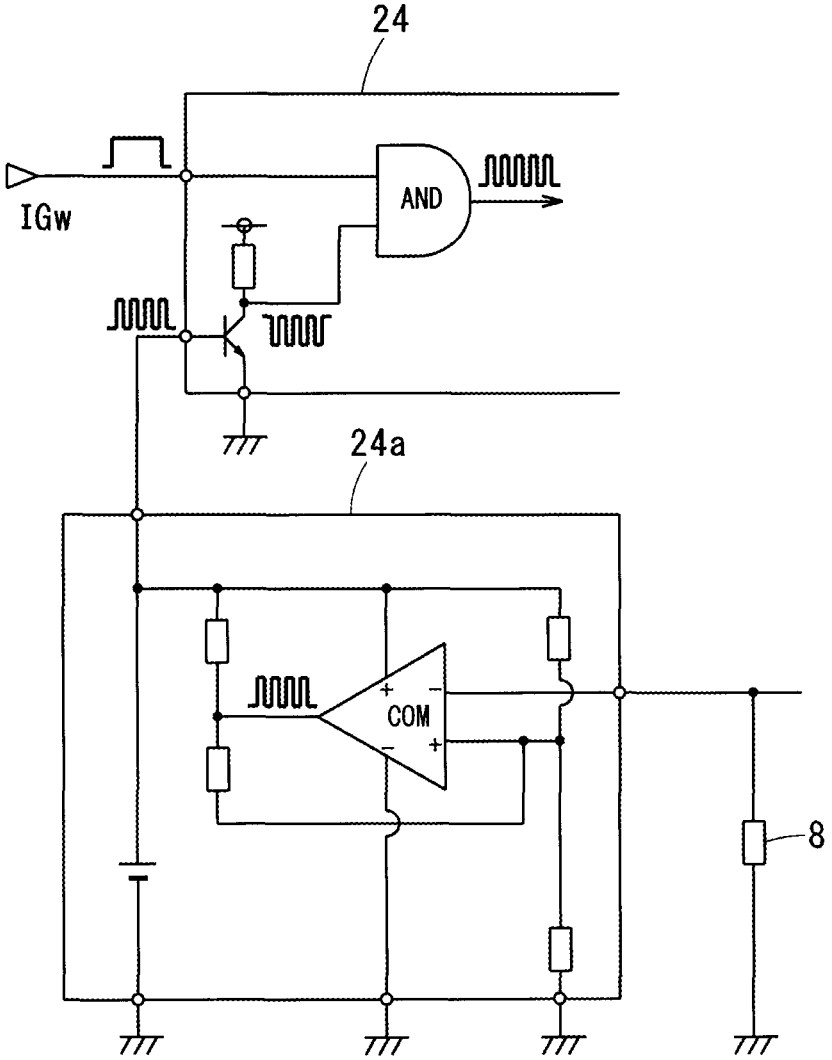
FIG. 4 is an electric circuit diagram of another feedback control circuit (first embodiment)

A concrete example of the feedback control circuit 24*a*, as shown in FIG. 3 and FIG. 4, monitors a secondary current by using the discharge current detection resistor 8, and feed-back controls an on-off state of the energy input switching section 23 so that the monitored secondary current is kept in a predetermined target value.

Note that the control of the secondary current is not limited to feed back control. The energy input switching section 23 may be on-off controlled by open control (feed-forward control) so that the secondary current is kept in a predetermined target value. In addition, the target value of the secondary current during continuous spark discharge may be constant, or may be changed depending on the driving state of the engine (a discharge current setting signal provided from the ECU 100).

(Description of Operation of the First Embodiment)

Figure 2:
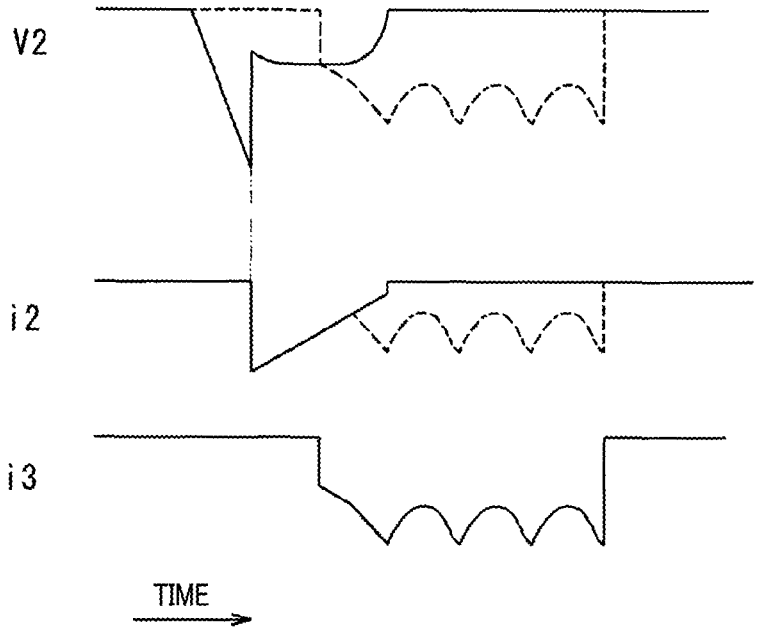
FIG. 2 is a timing chart for illustrating operation of the ignition apparatus for an internal-combustion engine (first embodiment)

Next, referring to FIG. 2, spark discharge operation performed by the main ignition CDI circuit 5 and the energy input circuit 6 will be described. Note that the solid line of "V2" in FIG. 2 represents voltage change of the secondary coil 4 caused by the operation of the main ignition CDI circuit 5. The broken line of "V2" represents voltage change of the secondary coil 4 caused by the operation of the energy input circuit 6. In addition, the solid line of "i2" in FIG. 2 represents current change of the secondary coil 4 caused by the operation of the main ignition CDI circuit 5. The broken line of "i2" represents current change of the secondary coil 4 caused by the operation of the energy input circuit 6. Furthermore, the solid line of "i3" in FIG. 2 represents current change of the secondary coil 4 caused by the operation of the energy input circuit 6.

If the ECU 100 outputs an ignition signal, the ignition driver circuit 14 turns on the main ignition switching unit 13. Then, the electric charge (electric energy) stored in the main ignition capacitor 11 are released to the primary coil 3, and high voltage is induced in the secondary coil 4, whereby main ignition is started in the spark plug 1.

If the main ignition is started in the spark plug 1, and the primary current exceeds the maximum value, the primary current circulates through the first diode 7, whereby the secondary current attenuates in a state of a substantially triangular wave shape without positive and negative alternation. Next, before the secondary current lowers to a "predetermined lower limit current value (current value for maintaining spark discharge)" the ECU 100 outputs a discharge continuation signal, whereby electric charge is additionally released to the first energy input line β corresponding to the spark plug 1 selected by the cylinder selection signal to continue the spark discharge.

Figure 5:
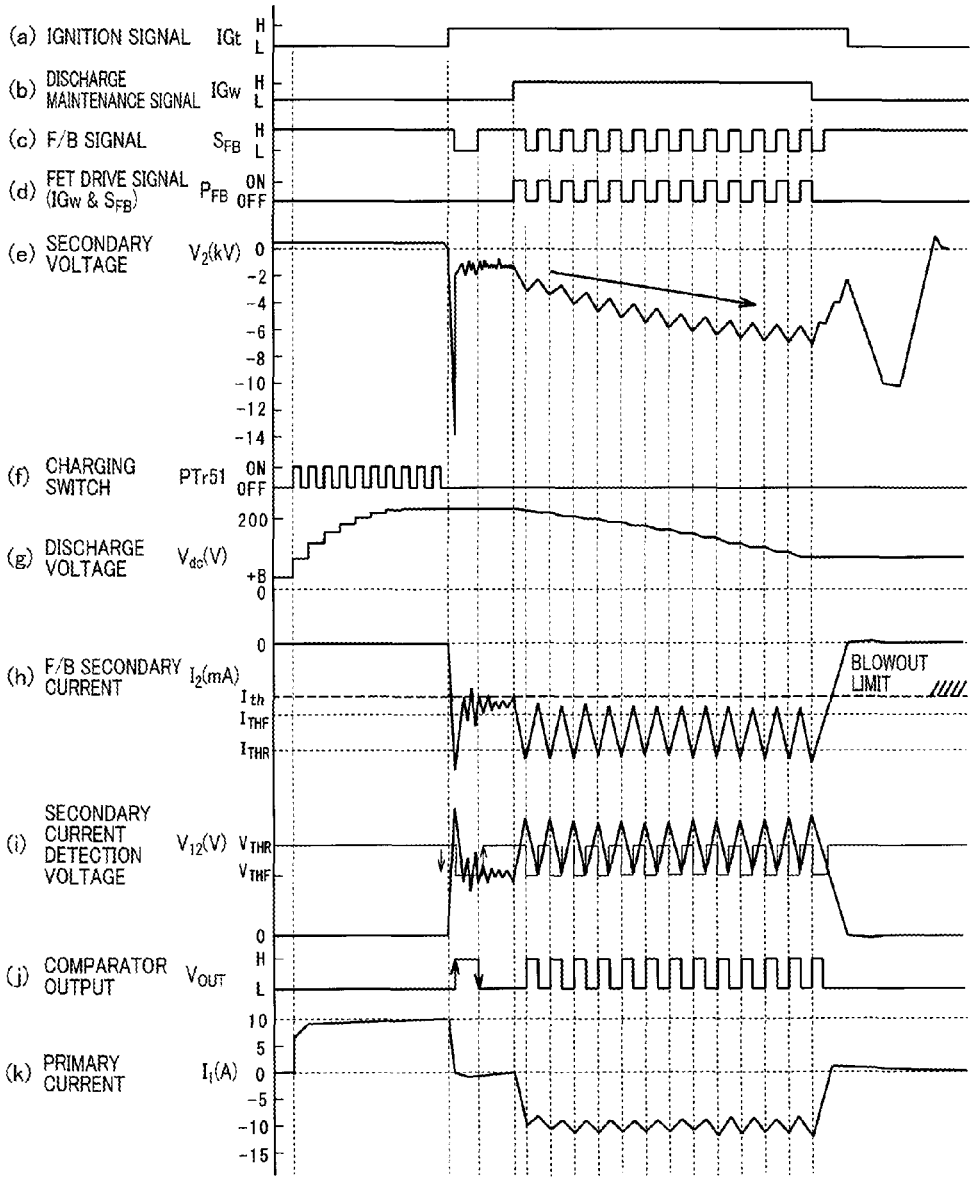
FIG. 5 is a specific timing chart of the ignition apparatus for an internal-combustion engine (first embodiment)

Specifically, if the ECU 100 outputs a discharge continuation signal, as shown in FIG. 5, the energy input switching section 23 is on-off controlled to sequentially input some electric charges stored in the energy input capacitor 21 to the primary coil 3. Thereby, every time the energy input switching section 23 is turned on, a primary current additionally flows to the primary coil 3. Every time the primary current is added, a secondary current flows in the direction, in which a secondary flows immediately after the main ignition, sequentially and additionally. In addition, every time the energy input switching section 23 is turned off, a current circulates through the first diode 7, whereby spark discharge of the same polarity continues.

On-off controlling the energy input switching section 23 by the operation of the feedback control circuit 24*a* can continuously hold the secondary current so that spark discharge can be maintained (within a range of the target secondary current).

Specifically, if spark discharge flows by a strong airflow or the like generated in the cylinder, the length of the spark discharge extends to increase the discharge voltage, whereby the secondary current decreases. If the secondary current decreases below a predetermined value, the energy input switching section 23 is turned on by feed back control of the secondary current, whereby electric energy is input to the primary coil 3 again. Then, the secondary current increases. When the secondary current reaches the target value, the energy input is stopped. As a result, even when the spark discharge is blown by airflow, and the length of the spark discharge extends, the secondary current is kept substantially constant, which can maintain discharge maintenance voltage to avoid blowout of the spark discharge.

Accordingly, while the discharge continuation signal continues, the continuous spark discharge can be continued in the spark plug 1, which can achieve high ignitability.

(Advantageous Effect 1 of the First Embodiment)

As described above, according to the ignition apparatus of the first embodiment, immediately after main ignition is started by the main ignition CDI circuit 5, electric charge stored in the energy input capacitor 21 is input to the primary coil 3 to continuously make a secondary current flow in the same direction and to the secondary coil 4, thereby making continuous spark discharge following the main ignition continue.

The energy input circuit 6 controls electric energy to be input to the primary coil 3. Thereby, wear of the electrodes of the spark plug 1 due to the repetition of blowout and re-discharge can be reduced, and optimally controlling the electric power for maintaining discharge can suppress wasteful power consumption. In addition, high ignitability can be exerted.

Specifically, since the energy input circuit 6 continuously makes a secondary current flow in the same direction to achieve continuous spark discharge, the secondary voltage does not alternate, which makes it difficult to interrupt spark discharge in the continuous spark discharge following the main ignition. Hence, even in a state of lean combustion and in a driving state where an airflow having high speed is generated in a cylinder (driving state where blowout easily occurs under usual circumstances), the blowout of the spark discharge can be avoided.

While the ignition generated only by the main ignition CDI circuit 5 has an advantage that spark discharge resistant to a smolder can be produced, the ignition has a property of easily causing blowout. In contrast, according to the embodiment, the main ignition continued from the formation of discharge is performed by CDI ignition, and continuous spark discharge is continuously generated by DC. Thereby, spark discharge resistant to a smolder and resistant to blowout can be generated. That is, the use of the ignition apparatus of the embodiment can generate spark discharge resistant to a smolder and difficult to be blown out, as required.

(Advantageous Effect 2 of the First Embodiment)

Since the energy input circuit 6, which makes spark discharge continue, controls electric energy stored in the energy input capacitor 21 so as to be input to the primary coil 3, the circuit configuration thereof can be simplified.

Hence, the circuit configuration inside the ignition circuit unit can be simplified. As a result, the ignition circuit unit can be decreased in size, and the cost can be reduced.

(Advantageous Effect 3 of the First Embodiment)

The ignition apparatus is provided with the main ignition boosting circuit 10 and the energy input boosting circuit 20 in common.

Hence, the circuit configuration inside the ignition circuit unit can be simplified. As a result, the ignition circuit unit can be decreased in size, and the cost can be reduced.

Second Embodiment

Figure 6:
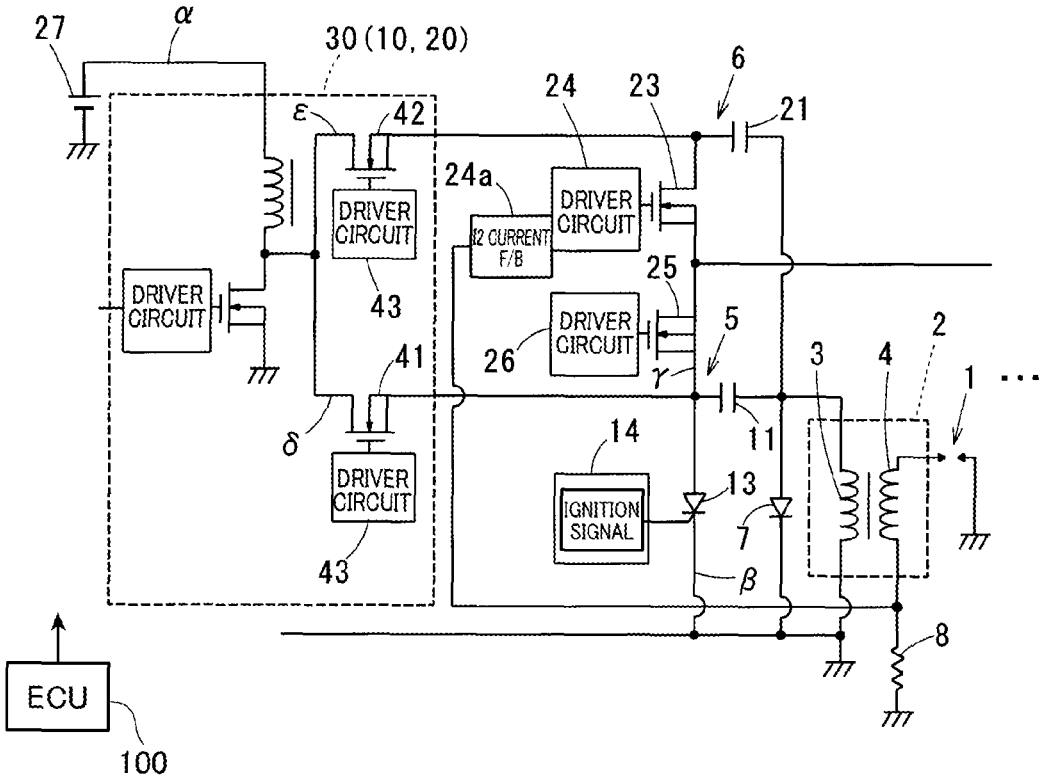
FIG. 6 is a diagram showing a schematic configuration of an ignition apparatus for an internal-combustion engine (second embodiment)

The second embodiment will be described with reference to FIG. 6 and FIG. 7. Note that, in the following embodiments, the same reference numerals as those of the first embodiment indicate the same functional components.

In the second embodiment, as in the case of the first embodiment, the main ignition boosting circuit 10 and the energy input boosting circuit 20 are provided in common. In addition, in the second embodiment, the operation timing of the common boosting circuit is switched between (i) a main ignition charging time period X during which the main ignition capacitor 11 is charged and (ii) an energy input charging time period Y during which the energy input capacitor 21 is charged.

Specifically, the boosting circuit 30 is configured by including

- a first charging selection switching section (first charging selection switching means) 41 that turns on and off a charging line δ of the main ignition capacitor 11,
- a second charging selection switching section (second charging selection switching means) 42 that turns on and off a charging line ϵ of the energy input capacitor 21; and
- a charging selection driver circuit 43 that changes on-off states of the first charging selection switch and the second charging selection switch to switch between the main ignition charging time period X during which the main ignition capacitor 11 is charged and the energy input charging time period Y during which the energy input capacitor 21 is charged.

Furthermore, as a concrete example, the ECU 100 of the present second embodiment is provided so as to output a charging destination indication signal used for switching between an on time period of the first charging selection switching section 41 (main ignition charging time period X) and an on time period of the second charging selection switching section 42 (energy input charging time period Y), when the ECU 100 outputs the boosting command signal for operating the boosting circuit 30.

Then, the charging selection driver circuit 43 switches between the on time period of the first charging selection switching section 41 (main ignition charging time period X) and the on time period of the second charging selection switching section 42 (energy input charging time period Y) based on the charging destination indication signal provided from the ECU 100.

Figure 7:
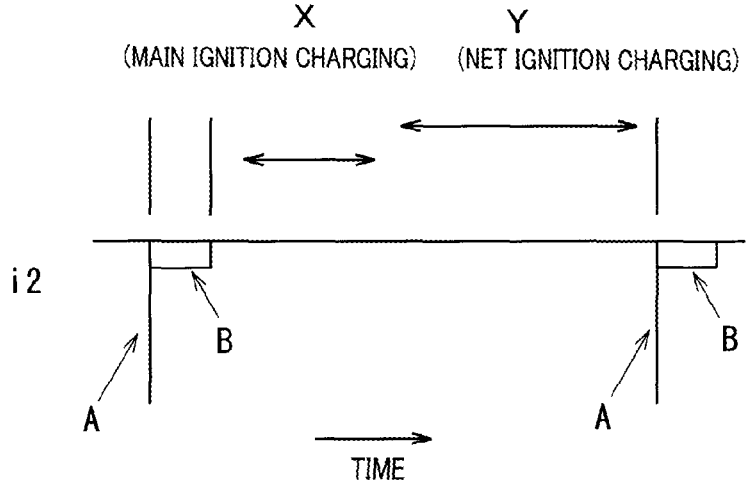
FIG. 7 is a timing chart for illustrating charging operation (second embodiment)

As shown in FIG. 7, a concrete example of the on time period of the first charging selection switching section 41 (main ignition charging time period X) is a charging time period starting from the charging start timing by which a predetermined time period has passed from the ignition timing. As shown in FIG. 7, a concrete example of the on time period of the second charging selection switching section 42 (energy input charging time period Y) is a charging time period starting after the main ignition charging time period X has passed.

Since the amount of electric energy stored in the energy input capacitor 21 is set to be larger than the amount of electric energy stored in the main ignition capacitor 11, the relationship "the main ignition charging time period X<the energy input charging time period Y" is established. Furthermore, the charging voltage of the main ignition capacitor 11 and the charging voltage of the energy input capacitor 21 can be set to given values. Note that "i2" in FIG. 7 shows a current change of the secondary coil 4. Sign A in FIG. 7 indicates a schematic waveform of the main ignition. Sign B in FIG. 7 indicates a schematic waveform of the continuous spark discharge.

Third Embodiment

Figure 8:
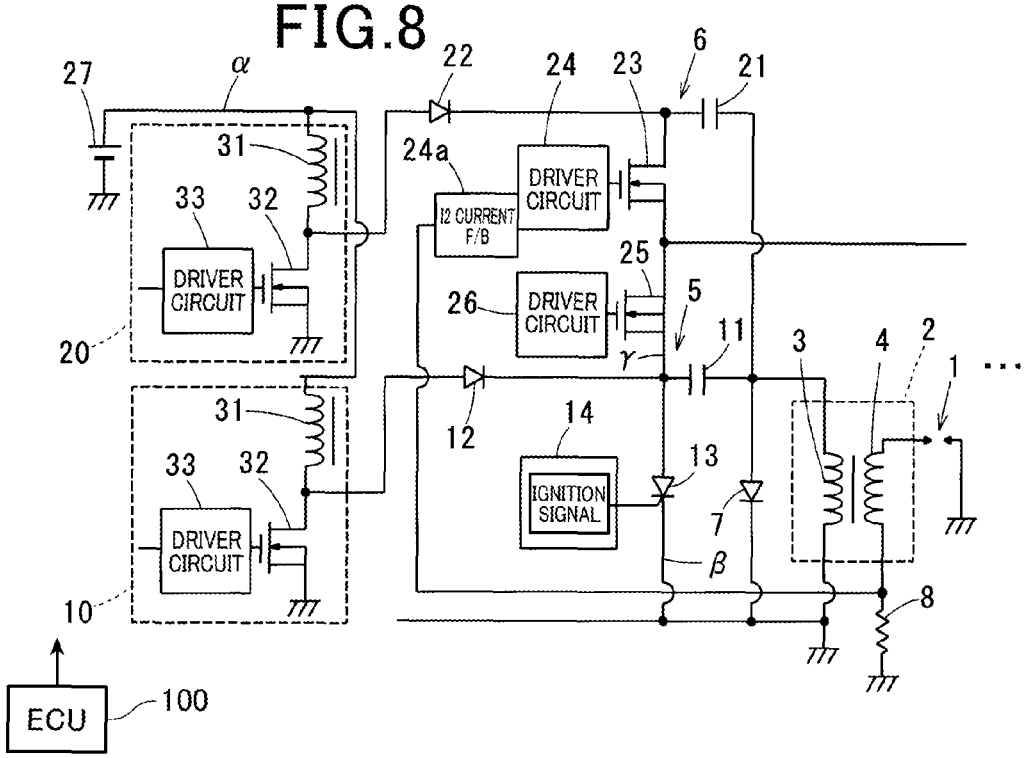
FIG. 8 is a diagram showing a schematic configuration of an ignition apparatus for an internal-combustion engine (third embodiment)

The third embodiment will be described with reference to FIG. 8.

In the third embodiment, the main ignition boosting circuit 10 and the energy input boosting circuit 20 are independently provided. Thereby, the charging voltage of the main ignition capacitor 11 and the charging voltage of the energy input capacitor 21 can be set to different values. As a result, each of the main ignition boosting circuit 10 and the energy input boosting circuit 20 can be specifically designed, whereby the ignition apparatus can decrease in size and in power consumption.

As a concrete example, 100 V or more of the charging voltage of the main ignition capacitor 11 is required to generate the main ignition (several tens kV or more of secondary voltage). Preferably, the charging voltage of the main ignition capacitor 11 is set to preferably 250 V or more. Meanwhile, 100 V or more of the charging voltage of the energy input capacitor 21 is required to generate the continuous spark discharge (several kV or more of secondary voltage). Preferably, the charging voltage of the energy input capacitor 21 is set to preferably 50 V or more.

As described above, independently providing the main ignition boosting circuit 10 and the energy input boosting circuit 20 can easily react to the difference between the charging voltage required for the main ignition CDI circuit 5 and the charging voltage required for the energy input circuit 6. In addition, since the withstand voltage of the energy input capacitor 21 can be lower, an inexpensive low-voltage and large-capacity type capacitor can be used as the energy input capacitor 21, which can reduce the cost of the ignition apparatus.

As described in the present third embodiment, independently providing the main ignition boosting circuit 10 and the energy input boosting circuit 20 can set the charging voltage of the main ignition capacitor 11 to be higher than the charging voltage of the energy input capacitor 21. In a concrete example for assisting in understanding, a 2 μF and 400 V capacitor is used as the main ignition capacitor 11, and a 4700 μF and 63V capacitor is used as the energy input capacitor 21.

As described above, independently providing the main ignition boosting circuit 10 and the energy input boosting circuit 20 can optimize charging voltage and charge of the main ignition capacitor 11 suited for the main ignition and charging voltage and charge of the energy input capacitor 21 suited for the continuous spark discharge, whereby the main ignition capacitor 11 and the energy input capacitor 21 can be formed as components that are decreased in size and inexpensive.

Fourth Embodiment

Figure 9:
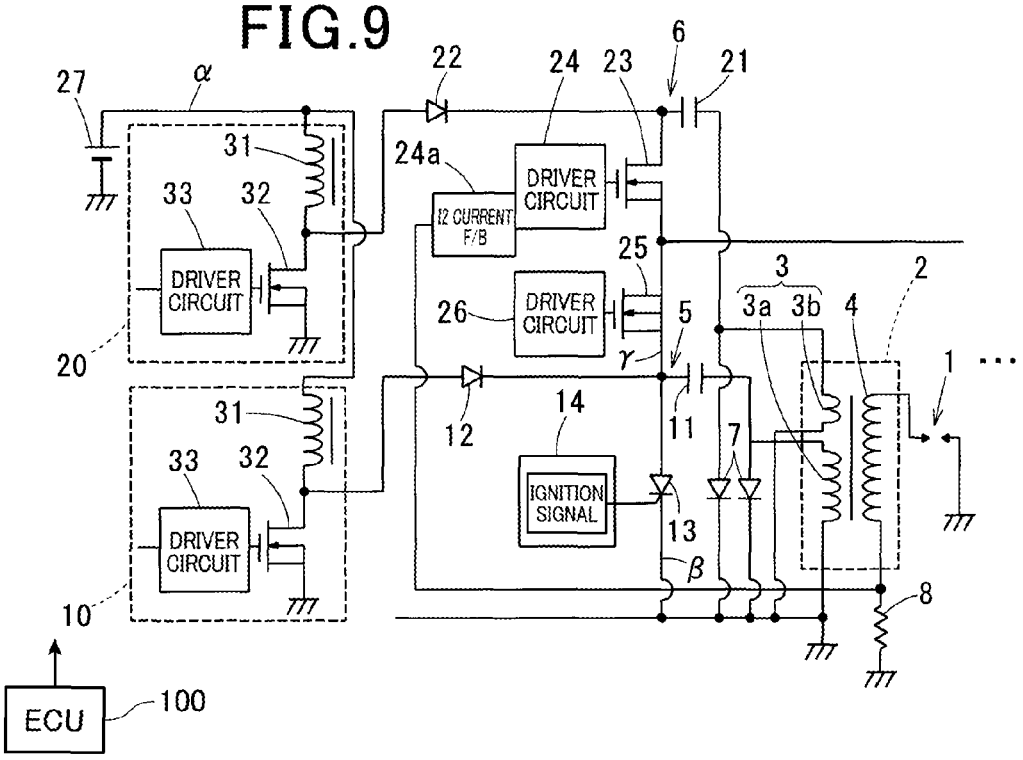
FIG. 9 is a diagram showing a schematic configuration of an ignition apparatus for an internal-combustion engine (fourth embodiment).

The fourth embodiment will be described with reference to FIG. 9.

In the fourth embodiment, the primary coil 3 includes a first winding 3*a* and a second winding 3*b* independently.

The first winding 3*a* is a winding for main ignition performing CDI ignition. The main ignition capacitor 11 is provided so as to input electric energy to the first winding 3*a*.

In addition, the second winding 3*b* is a winding for continuous spark discharge. The energy input capacitor 21 is provided so as to input electric energy to the second winding 3*b*.

As described, independently providing the first winding 3*a* for main ignition and the second winding 3*b* for continuous spark discharge can set smaller the number of turns of the second winding 3*b* that receives energy from the energy input capacitor 21, whereby the resistance value of the energy input coil can be decreased.

Hence, the primary current can be increased which is obtained when electric charge is input from the energy input capacitor 21. Furthermore, even when electric energy is input with the small amount of electric charge to the second winding 3*b*, the secondary current required for maintaining continuous spark discharge can be generated in the secondary coil 4. Furthermore, separating the first winding 3*a* for main ignition and the second winding 3*b* for continuous spark discharge can disperse the heat generated from the windings. As a result, the durability of the ignition coil 2 can be increased, whereby an ignition apparatus having high reliability can be provided.

In addition, electric power used for continuous spark discharge can be reduced, whereby the power consumption of the ignition apparatus can be minimized. In addition, the energy input boosting circuit 20 can be simplified.

INDUSTRIAL APPLICABILITY

The plurality of embodiments described above may be combined with each other.

In addition, since the combination of the main ignition by CDI ignition and the continuous spark discharge can improve ignitability, the present invention can be applied to various engines desired to improve ignitability thereof.

Hereinafter, concrete examples will be described.

In the above embodiments, examples are illustrated in which an ignition apparatus of the present invention is used for a gasoline engine. However, since ignitability of an air-fuel mixture can be improved by continuous spark discharge, the ignition apparatus of the present invention may be applied to an engine using ethanol fuel or mixed fuel. Needless to say, even when the ignition apparatus of the present invention is used for an engine having a possibility of using low-grade fuel, ignitability can be improved by continuous spark discharge.

In the above embodiments, example are illustrated in which the ignition apparatus of the present invention is used for a lean burn engine that can perform lean combustion (lean burn combustion) driving to improve ignitability by continuous spark discharge when lean combustion is performed in which ignitability becomes worse. However, even in a combustion state different from lean combustion, ignitability can be improved by continuous spark discharge. Hence, the ignition apparatus may be applied to not only the lean burn engine but also an engine that does not perform lean combustion.

In addition, the ignition apparatus may be applied to a high EGR engine (engine that can increase a feedback ratio of exhaust gas returned to the engine as EGR gas) to generate continuous spark discharge during high EGR so as to improve ignitability.

Similarly, continuous spark discharge may be performed when the temperature of the engine is low, which lowers ignitability, to improve ignitability when the temperature of the engine is low.

In the above embodiments, examples are illustrated in which the ignition apparatus of the present invention is used for a direct injection type engine that injects fuel into a combustion chamber directly. However, the ignition apparatus of the present invention may be used for a port-injection type engine that injects fuel to the intake air upstream side of an inlet valve (in an inlet port).

The above embodiments have described a high airflow engine, which is a supercharged lean burn engine. However, the ignition apparatus of the present invention may be used for an engine that actively generate a rotational flow (tumble flow, swirl flow, or the like) of an air-fuel mixture in a cylinder to avoid "blowout of spark discharge due to a rotational flow". In addition, the ignition apparatus may be used for an engine that does not have a rotational flow control section (tumble flow control valve, swirl flow control valve, or the like).

In the above embodiments, the present invention is applied to a DI type ignition apparatus in which the ignition coils 2 are respectively provided for the spark plugs 1. However, the ignition apparatus is not limited to DI type. For example, the present invention may be applied to an ignition apparatus of a single-cylinder engine (e.g. for a motorcycle or the like) in which the ignition coil 2 is mounted at a position different from that of the spark plug 1.

In the above embodiments, examples are illustrated in which a chopper type DC-DC converter is used as an example of the boosting circuit. However, the concrete example of the boosting circuit is not limited to this. For example, a boosting circuit configured by a transformer including a secondary winding and a tertiary winding may be used to perform boosting operation at high speed so as to improve the efficiency.

The ignition apparatus for an internal-combustion engine of the present embodiment includes a main ignition CDI circuit for performing main ignition (spark discharge performed when discharge is started) and an energy input circuit for continuing ignition. Note that, in the above description, the spark discharge arbitrarily continued with the same polarity as that with which the main ignition is performed is referred to as "continuous spark discharge".

After the main ignition is started, the energy input circuit releases the electric charge stored in the energy input capacitor to the primary coil to make a secondary current flow in the same direction and to the secondary coil of the ignition coil, thereby making continuous spark discharge continue with the same polarity following the main ignition.

The energy input circuit controls electric energy to be input to the primary coil to control the secondary current, thereby accordingly forming continuous spark discharge serially without interruption. Hence, re-discharge at high voltage is not required when spark discharge is blown out, wear on the electrodes of the spark plug can be reduced, and power consumption can be reduced. Thereby, higher ignitability can be exerted.

Specifically, the energy input circuit inputs energy to make the secondary current continuously flow in the same direction so as to be equal to or more than a discharge maintenance current, thereby making the continuous spark discharge continue. Hence, the secondary voltage does not alternate, and the spark becomes strong in the continuous spark discharge following the main ignition, whereby the spark discharge becomes difficult to interrupt. Therefore, differing from the technique of Patent Literature 1 described above, the problem can be avoided that blowout of the spark discharge occurs due to a rotational flow or the like generated in a cylinder.

Further specifically, in so-called CDI ignition, since the rise time of the secondary voltage is short, resistant to a smolder is produced. However, on the other hand, since the CDI ignition has short discharge time, the CDI ignition has a property of easily causing blowout. In contrast, in the present embodiment, the main ignition is performed by the CDI ignition, followed by performing the continuous spark discharge with the same polarity. Hence, spark discharge can be generated which is resistant to a smolder and difficulty in causing blowout due to strong spark by which a spark current equal to or more than a predetermined current continues. That is, according to the ignition apparatus of the present embodiment, spark discharge resistant to a smolder and difficult to cause blowout can be generated.

Meanwhile, since the energy input circuit of the present embodiment controls the electric energy stored in the energy input capacitor so as to be input to the primary coil, the circuit configuration thereof can be simplified.

Hence, compared with the technique of Patent Literature 1 described above, the ignition apparatus can be decreased in size (specifically, decrease in size of the ignition circuit unit, and the like), and the cost can be reduced.

What is claimed is:

1. An ignition apparatus for an internal-combustion engine, the ignition apparatus comprising:

a main ignition CDI circuit that has a main ignition boosting circuit boosting battery voltage and a main ignition capacitor storing electric charge boosted by the main ignition boosting circuit, and that releases the electric charge stored in the main ignition capacitor to a primary coil of an ignition coil to make an ignition plug generate spark discharge; and an energy input circuit that has an energy input boosting circuit boosting battery voltage and an energy input capacitor storing electric charge boosted by the energy input boosting circuit, and that releases the electric charge stored in the energy input capacitor to the primary coil, during a spark discharge started by operation of the main ignition CDI circuit, to make a secondary current flow in the same direction and to a secondary coil of the ignition coil, thereby making spark discharge continue which is started by the operation of the main ignition CDI circuit.

2. The ignition apparatus for an internal-combustion engine according to claim 1, wherein the main ignition CDI circuit includes a diode that is connected in parallel with the primary coil.

3. The ignition apparatus for an internal-combustion engine according to claim 1, wherein the main ignition boosting circuit and the energy input boosting circuit are provided in common.

4. The ignition apparatus for an internal-combustion engine according to claim 3, wherein operation timing of a common boosting circuit is switched between a main ignition charging time period during which the main ignition capacitor is charged and an energy input charging time period during which the energy input capacitor is charged.

5. The ignition apparatus for an internal-combustion engine according to claim 1, wherein the main ignition boosting circuit and the energy input boosting circuit are independently provided.

6. The ignition apparatus for an internal-combustion engine according to claim 1, wherein discharge voltage of the main ignition capacitor and discharge voltage of the energy input capacitor are different from each other.

7. The ignition apparatus for an internal-combustion engine according to claim 1, wherein the primary coil includes a first winding and a second winding independently, the main ignition capacitor inputs electric energy to the first winding, and the energy input capacitor inputs electric energy to the second winding.

* * * * *